US006572459B2

(12) United States Patent
Bonachera

(10) Patent No.: US 6,572,459 B2
(45) **Date of Patent: *Jun. 3, 2003**

(54) MACHINE FOR MACHINING IN PARTICULAR SUPERFINISHING, CYLINDRICAL SURFACES OF CIRCULAR CYLINDRICAL WORKPIECES, USING AN ABRASIVE BELT MOVING TANGENTIALLY

(75) Inventor: Richard Bonachera, Vincennes (FR)

(73) Assignee: Societe des Procedes et Machines Speciales, Evry Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,272

(22) Filed: Aug. 10, 1998

(65) Prior Publication Data

US 2001/0029159 A1 Oct. 11, 2001

(30) Foreign Application Priority Data

Aug. 12, 1997 (FR) ..... 97 10299

(51) Int. Cl.[7] ..... B24B 1/00

(52) U.S. Cl. ..... 451/172; 451/168; 451/173; 451/338; 451/332; 451/229; 451/307

(58) Field of Search ..... 451/168, 172, 451/173, 338, 332, 229, 307

(56) References Cited

U.S. PATENT DOCUMENTS

| | | | | |
|---|---|---|---|---|
| 2,345,308 A | * | 3/1944 | Wallace | 451/296 |
| 5,224,300 A | * | 7/1993 | Pineau | 451/168 |
| 5,471,796 A | * | 12/1995 | Thompson | 451/296 |

FOREIGN PATENT DOCUMENTS

| | | |
|---|---|---|
| EP | 0495691 A1 | 7/1992 |
| GB | 2206299 A | 1/1989 |

* cited by examiner

*Primary Examiner*—Joseph J. Hail, III
*Assistant Examiner*—Shantese McDonald
(74) *Attorney, Agent, or Firm*—Smith, Gambrell & Russell, LLP

(57) ABSTRACT

Machine for machining using abrasive belts circular workpieces supported by at least one pair of parallel rollers.

To pass the workpieces under the machining station(s) 6, the support rollers 16 driven in rotation are moved in translation parallel to their axes.

The rollers 16 are preferably mounted on a table 13 mobile in translation which can also carry means 19 for positioning the workpieces to be machined.

14 Claims, 4 Drawing Sheets

MACHINE FOR MACHINING IN PARTICULAR SUPERFINISHING, CYLINDRICAL SURFACES OF CIRCULAR CYLINDRICAL WORKPIECES, USING AN ABRASIVE BELT MOVING TANGENTIALLY

The present invention concerns a machine for machining, in particular superfinishing, cylindrical surfaces of circular cylindrical workpieces by moving an abrasive belt tangentially over the cylindrical surface of at least one workpiece in at least one machining station, which abrasive belt, fed from a pay-out spool, passes over a pressure roller before it is rewound onto a take-up spool, the workpiece being supported by a pair of spaced parallel rotary support rollers.

So-called "centerless" tangential abrasive belt machines comprising one or more fixed machining stations and stationary support rollers advance the workpiece relative to the stationary support rollers either using a pair of support rollers inclined to each other (see for example EP-A-495 691), although this imparts a non-positive advance movement, or positioners mounted on a chain fed with an advance movement, the positioners passing between the pairs of parallel rollers. In this latter case a positive advance movement is certainly imparted to the workpieces but because the rollers are stationary the advance movement of the workpieces on the rollers leads to slipping and therefore rubbing of the workpieces on the rollers. This can degrade the surface condition of the workpieces.

The present invention is directed to a machine of the type defined hereinabove which assures a positive advance movement between the workpieces to be machined and the machining station or stations without slipping and therefore without rubbing of the workpieces on the support rollers.

The machine in accordance with the present invention comprises a support assembly on which the support rollers are mounted so that they can rotate about their axis. The machine further includes a machining assembly comprising one or more machining stations. One of said assemblies is mobile in translation parallel to the axes of the support rollers relative to the other assembly. The machine further includes means for rotating the support rollers about their axis and means for moving one of said assemblies in translation parallel to the axes of the support rollers relative to the other assembly.

In the context of the invention, the mobile assembly can be either the machining assembly carrying the machining unit or units or the support assembly carrying the support rollers, the other assembly being stationary.

The first variant can be particularly advantageous for machining long workpieces and the second variant is more particularly preferable for machining relatively short workpieces.

The machine on which the mobile assembly moves can advantageously comprise at least one pair of support rollers mounted on a table moving in translation.

To exclude any slipping and therefore any rubbing between the workpieces and the support rollers, the support assembly can advantageously carry, in addition to the support rollers, at least one workpiece positioning means designed to act on the workpiece carried by the pair of rollers to position the workpiece axially relative to the support rollers whilst enabling it to rotate.

The positioning means or each positioning means preferably comprises a rotary positioner contributing to the rotation movement of the workpiece during machining. This eliminates or at least reduces slipping and therefore rubbing between the workpiece and the positioner.

The positioning means or each positioning means is preferably disposed at a central position relative to the workpiece, i.e. in a median position relative to the two rollers supporting the workpiece.

The support rollers are preferably rotated by a motor mounted on the table of the mobile support assembly.

The table, which can move in translation on slides, can advantageously be moved in translation by a screw-and-nut type drive system.

The machine preferably comprises a plurality of successive machining stations along the translation direction so that the same workpiece can be subjected to a plurality of successive operations in cascade, for example a plurality of superfinishing operations with increasingly fine grit sizes.

Two illustrative and non-limiting embodiments of a machine in accordance with the invention will be described in more detail hereinafter with reference to the accompanying diagrammatic drawings; in the drawings.

Figure 1:
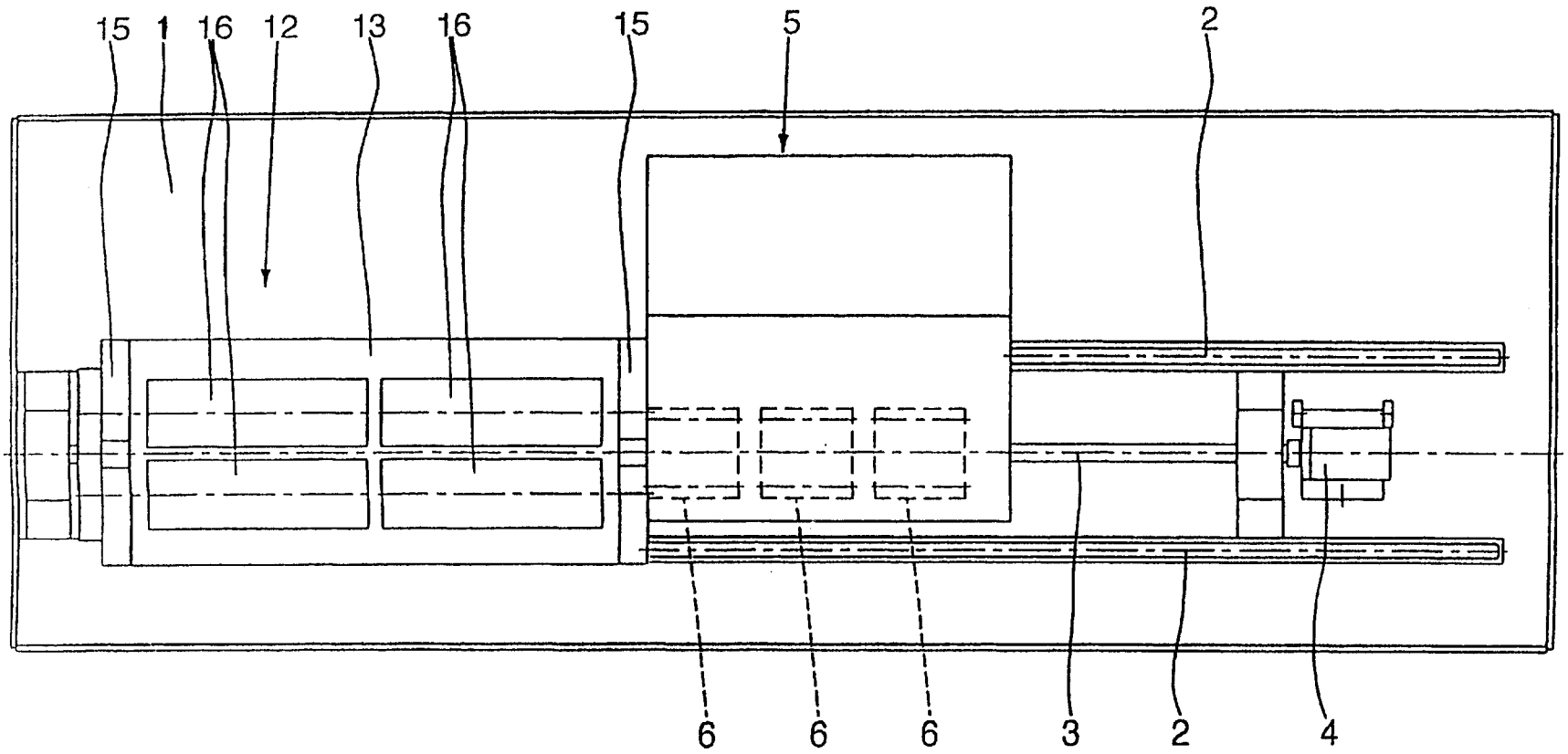
FIG. 1 is a top view of a machine in accordance with the invention.
Figure 2:
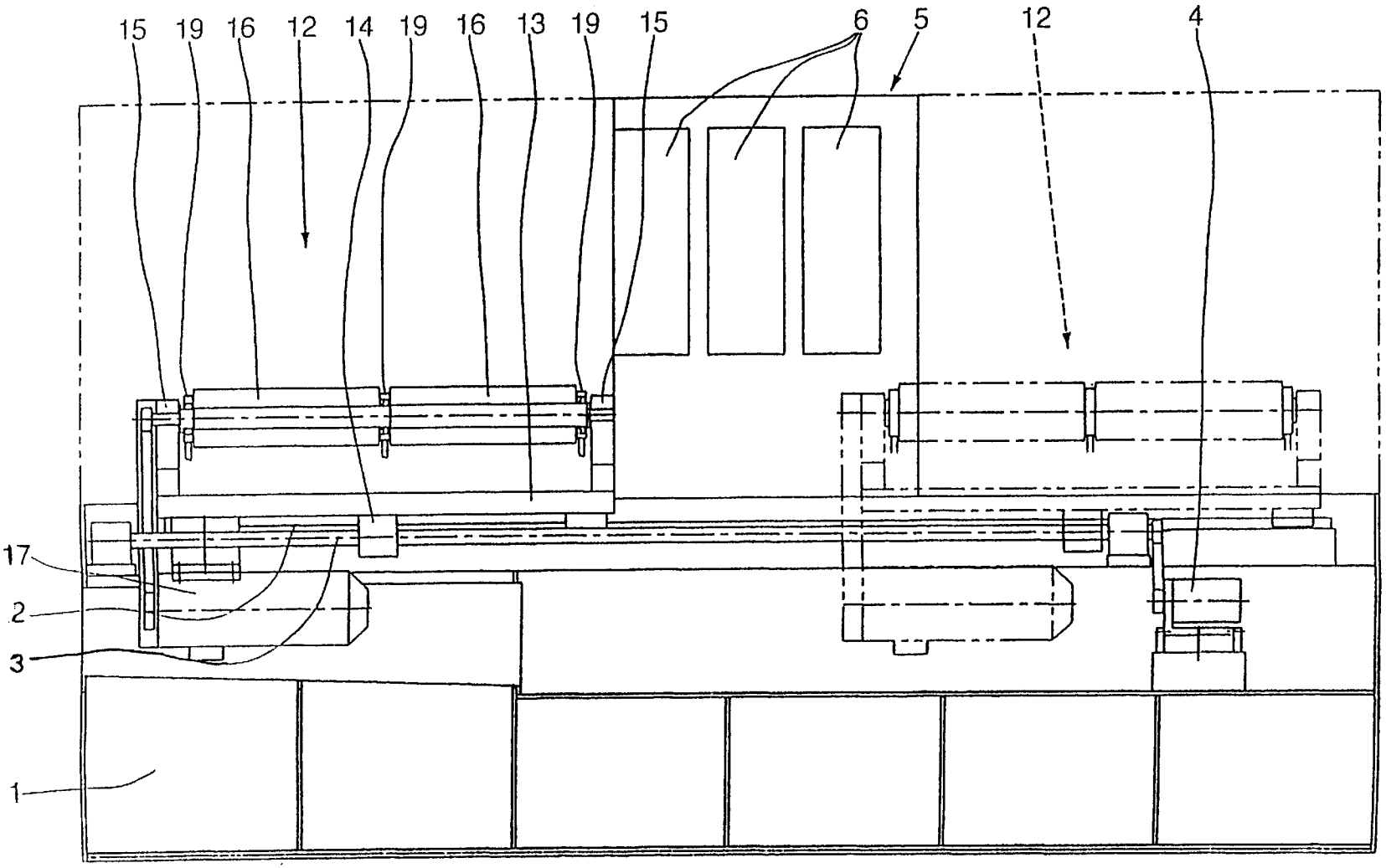
FIG. 2 is a part-sectional lateral elevation view of the machine from FIG. 1.
Figure 3:
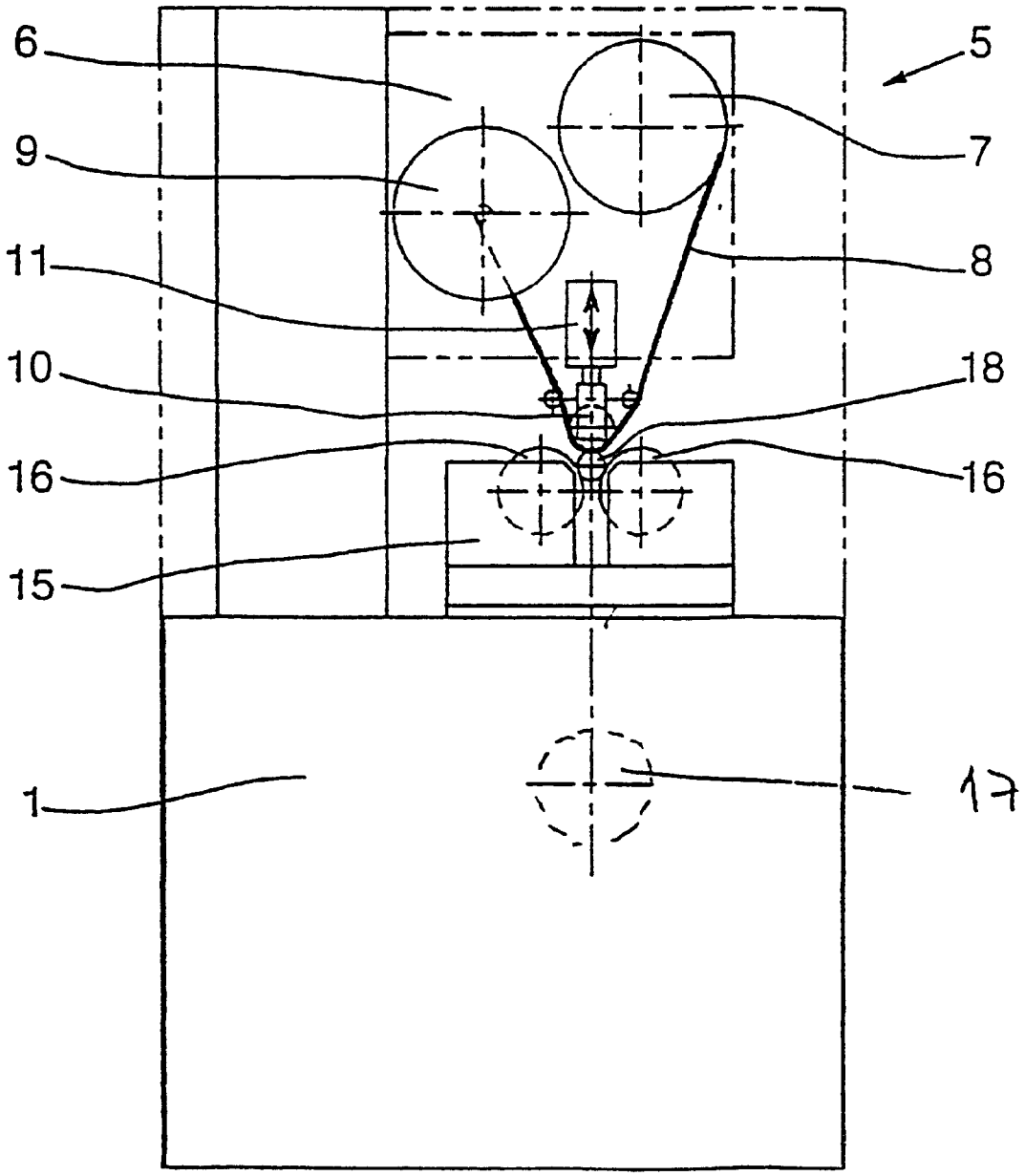
FIG. 3 is an end view of the machine from FIGS. 1 and 2.

As shown in FIGS. 1 through 3, the abrasive belt machine for machining, preferably for superfinishing, cylindrical surfaces of circular cylindrical parts, has an elongate frame 1 carrying two parallel longitudinal slides 2 in the same horizontal plane and a longitudinal screw 3 between the two slides 2. The screw 3 can be rotated by a motor-gearbox 4.

A machining assembly 5 is mounted at a fixed position on the frame 1, above the slides 2, more or less halfway along them. The machining assembly 5 comprises three machining units or stations 6 in succession in the lengthwise direction of the slides 2. As shown primarily in FIG. 3, each machining station 6 essentially comprises a pay-out spool 7 of abrasive belt 8, a take-up spool 9 for the abrasive belt 8, a pressure roller 10 over which the abrasive belt 8 passes between the two spools 7 and 9, and an actuator 11, for example a piston and cylinder actuator, for moving the pressure roller 10 upwards and downwards.

Machining units of the above kind with a tangentially moving abrasive belt are well known in themselves, especially in the field of superfinishing. Reference may be had to patent application EP-A-495691, for example.

An assembly 12 is mounted to move in translation on the slides 2. The assembly 12 comprises a rectangular table 13 guided on the slides 2. The bottom face of the table 13 carries a nut 14 meshing with the screw 3.

The top face of the table 13 carries, on bearings 15, two pairs of parallel horizontal rollers 16, at least one roller of each pair being rotated by a motor 17 mounted under the table 13.

As shown in FIG. 3, the rollers 16 of each pair support a workpiece 18, rotation of the rollers 16 causing the workpiece 18 resting on the rollers to rotate.

To assure a positive advance movement of the workpiece 18 with the rollers 16 supporting it, and to prevent longitudinal slipping of the workpiece 18 relative to the rollers 16, and therefore any rubbing that could degrade the surface condition of the part 18, means are provided on the table 13 to position the workpiece 18 axially relative to the support rollers 16.

In the example shown, these means comprise rotary positioners 19 at the axial ends of the rollers 16 bearing against the posterior end of the workpiece 18 during its advance movement (from left to right in FIGS. 1 and 2) under the machining assembly 5. Given that the positioner advances synchronously with the roller 16 and bears against the posterior end face of the workpiece 18, the cylindrical surface of the workpiece 18, which is superfinished by the machining assembly 5, does not rub against the rollers 16, which eliminates all risk of damage to this surface.

Because the positioner 19 is a rotary positioner, damage to the end face of the workpiece through rubbing on the positioner is also prevented.

The positioner 19 is preferably in a median position relative to the rollers 16 of the pair of rollers in front of it.

In the example shown, two pairs of rollers 16 are mounted one behind the other on the table 13 to support two workpieces to be machined which are passed successively under the machining assembly 5. A positioner 19 is provided at the posterior end of each pair of rollers 16 and an additional positioner 19 is provided at the anterior end of the anterior pair of rollers 16.

In FIG. 2 the mobile assembly 12 is shown in full line in a starting position (on the left in the figure) and in chain-dotted line in the position after machining (on the right in the figure). Note that the reciprocating assembly 12 enables the workpieces to be offloaded either in the loading position shown in full line, after the mobile assembly 12 returns to this position, or in the opposite position shown in chain-dotted line. In the latter case offloading can take place on the same side as loading or on the opposite side.

Figure 4:
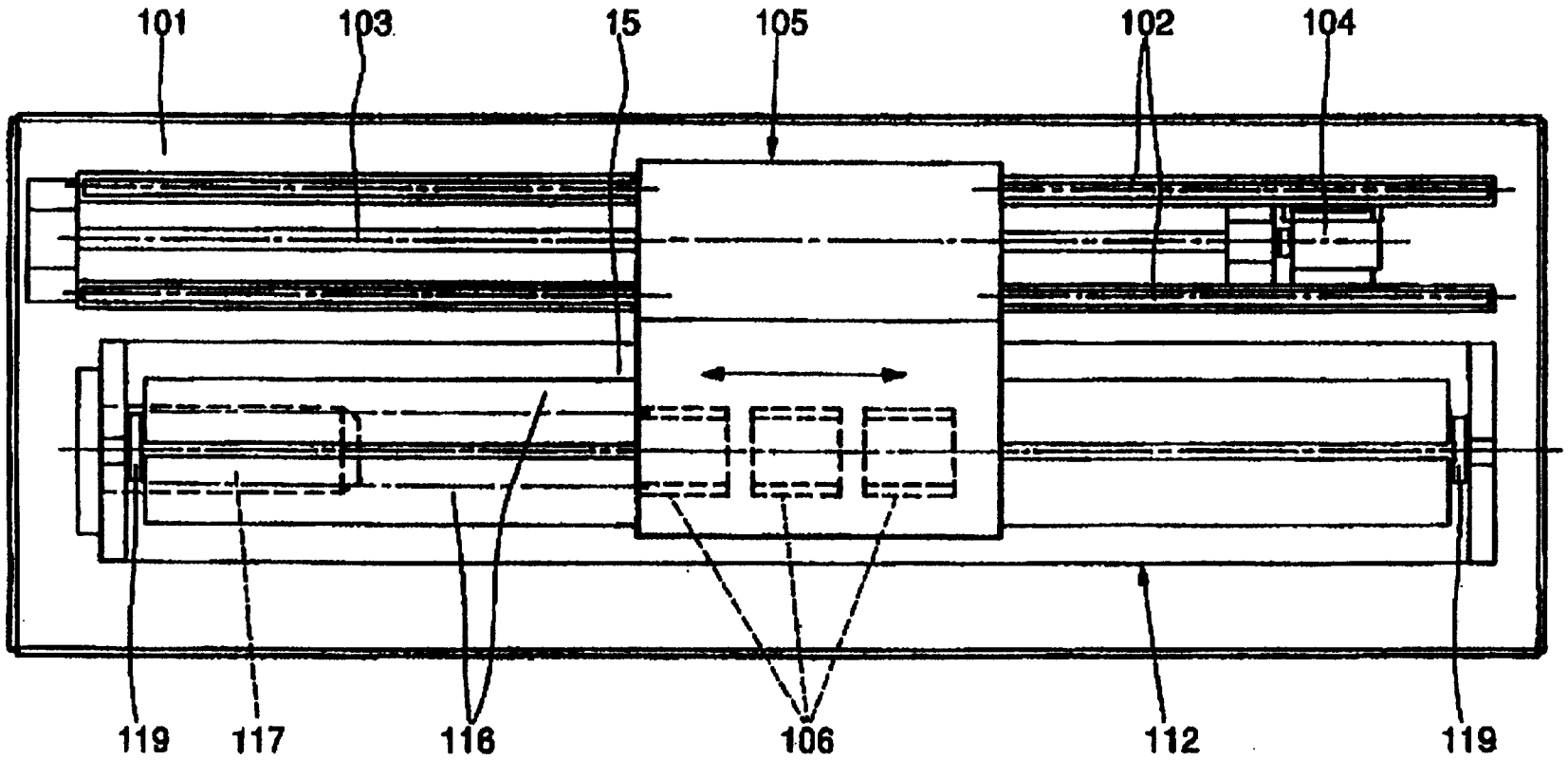
FIG. 4 is a top view of a variant of the machine from FIG. 1.

The embodiment of the machine shown in FIG. 4 has a frame 101, a machining assembly 105 mobile in translation and a stationary assembly 112 carrying pairs of support rollers 116. The assembly 105 includes three successive abrasive belt machining stations 106 and is moved on slides 102 by a screw 103 driven by a motor-gearbox 104. The stationary assembly 112 includes a motor 117 for rotating the support rollers 116. Positioning means 119, which can be of the same type as the positioners 19 of the embodiment shown in FIGS. 1 through 3, are preferably provided on the assembly 112 to position the workpieces relative to the rollers 116 during machining of the workpieces by longitudinal translation of the mobile assembly 105 in the direction of the arrow.

It goes without saying that the embodiments shown and described are given by way of illustrative and non-limiting example only and that many modifications and variants are possible within the scope of the invention.

Accordingly, the machining assembly 5, 105 can include a single machining station or a greater or smaller number of successive stations in cascade. The assembly 12 or 112 can include a single pair of support rollers 16, 116 or more than two successive pairs of support rollers, depending on the length of the workpieces to be machined. The means shown for guiding the mobile assembly 5, 112 (slides 2, 102) and for reciprocating this assembly (screw 3, 103, motor-gearbox 4, 104, nut 14) can be replaced by equivalent means fulfilling the same function. The positioners 19 in the median position between the roller 16 could be replaced, for example by positioning means mounted on the support rollers and turning with them.

What is claimed is:

1. A machine for machining cylindrical surfaces of circular cylindrical parts by tangential movement over the cylindrical surface of a workpiece, in at least one machining station, of an abrasive belt which, fed from a pay-out spool, passes over a pressure roller before the abrasive belt is rewound onto a take-up spool, the workpiece being supported by a pair of spaced parallel support rollers, wherein said machine comprises a support assembly (12, 112) on which the support rollers (16, 116) are mounted so that they can rotate about their axis, a machining assembly (5, 105) carrying the machining station or stations (6, 106), one of said assemblies being mobile in translation parallel to the axis of the support rollers relative to the other assembly, means (4, 104) for rotating the rollers about their axis, and means (3, 103) for moving one of said assemblies in translation parallel to the axes of the support rollers relative to the other assembly, and wherein said machine comprises a plurality of successive machining stations (6, 106) in the translation direction.

2. A machine according to claim 1 characterised in that the machining assembly (105) is mobile and is moved in translation relative to the stationary support assembly (112).

3. A machine according to claim 1 characterised in that the support assembly (12) is mobile and is moved in translation relative to the stationary machining assembly (5).

4. A machine according to claim 3 characterised in that the support assembly (12,112) carries at least one positioner (19, 119) for positioning the workpiece, said positioner being designed to operate on the workpiece carried by the pair of rollers to position the workpiece axially relative to the rollers (16, 116) while allowing the workpiece to rotate.

5. A machine according to claim 3 characterised in that the mobile support assembly (12) includes at least one pair of support rollers (16) mounted on a table (13) moved in translation.

6. A machine according to claim 5 characterised in that the support rollers (16) are rotated by a motor (17) mounted on the table (13).

7. A machine according to claim 5 characterised in that the support assembly (12, 112) carries at least one positioner (19, 119) for positioning the workpiece, said positioner being designed to operate on the workpiece carried by the pair of rollers to position the workpiece axially relative to the rollers (16, 116) while allowing the workpiece to rotate.

8. A machine for machining cylindrical surfaces of circular cylindrical parts by tangential movement over the cylindrical surface of a workpiece, in at least one machining station, of an abrasive belt which, fed from a pay-out spool, passes over a pressure roller before the abrasive belt is rewound onto a take-up spool, the workpiece being supported by a pair of spaced parallel support rollers, wherein said machine further comprises a support assembly (12, 112) on which the support rollers (16, 116) are mounted so that they can rotate about their axis, a machining assembly (5, 105) carrying the machining station or stations (6, 106), one of said assemblies being mobile in translation parallel to the axis of the support rollers relative to the other assembly, means (4, 104) for rotating the rollers about their axis, and means (3, 103) for moving one of said assemblies in translation parallel to the axes of the support rollers relative to the other assembly, wherein the support assembly (12) is mobile and is moved in translation relative to the stationary machining assembly (5), wherein the support assembly (12, 112) carries at least on positioner (19, 119) for positioning the workpiece, said positioner being designed to operate on the workpiece carried by the pair of rollers to position the workpiece axially relative to the rollers (16, 116) whilst allowing the workpiece to rotate, and wherein the positioner is a rotatable positioner (19, 119) contributing to the rotation movement to which the workpiece is subjected during machining.

9. A machine according to claim 8 characterised in that the positioner (19, 119) is disposed in a median position relative to the pair of support rollers (16, 116).

10. A machine according to claim 8 characterised in that said machine comprises a plurality of successive machining stations (6, 106) in the translation direction.

11. A machine for machining cylindrical surfaces of circular cylindrical parts by tangential movement over the cylindrical surface of a workpiece, in at least one machining station, of an abrasive belt which, fed from a pay-out spool, passes over a pressure roller before the abrasive belt is rewound onto a take-up spool, the workpiece being supported by a pair of spaced parallel support rollers, wherein said machine comprises a support assembly (12, 112) on which the support rollers (16, 116) are mounted so that they can rotate about their axis, a machining assembly (5, 105) carrying the machining station or stations (6, 106), one of said assemblies being mobile in translation parallel to the axis of the support rollers relative to the other assembly, means (4, 104) for rotating the rollers about their axis, and means (3, 103) for moving one of said assemblies in translation parallel to the axes of the support rollers relative to the other assembly, and wherein the mobile assembly (12, 105) is moved in translation by a screw-nut drive system (3, 4, 103).

12. A machine for machining cylindrical surfaces of circular cylindrical parts by tangential movement over the cylindrical surface of a workpiece, in at least one machining station, of an abrasive belt which, fed from a pay-out spool, passes over a pressure roller before the abrasive belt is rewound onto a take-up spool, the workpiece being supported by a pair of spaced parallel support rollers, characterised in that said machine comprises a support assembly (12, 112) on which the support rollers (16, 116) are mounted so that they can rotate about their axis, a machining assembly (5, 105) carrying the machining station or stations (6, 106), one of said assemblies being mobile in translation parallel to the axis of the support rollers relative to the other assembly, means (4, 104) for rotating the rollers about their axis, and means (3, 103) for moving one of said assemblies in translation parallel to the axes of the support rollers relative to the other assembly, wherein the machining assembly (5, 105) is mobile and is moved in translation relative to the stationary support assembly (12, 112), wherein the support assembly (12) includes at least one pair of support rollers (16) mounted on a table (13) moved in translation, and the support assembly (12, 112) carries at least one positioner (19, 119) for positioning the workpiece, said positioner being designed to operate on the workpiece carried by the pair of rollers to position the workpiece axially relative to the rollers (16, 116) while allowing the workpiece to rotate, and wherein the positioner is a rotatable positioner (19, 119), contributing to the rotating movement to which the workpiece is subjected during machining.

13. A machine according to claim 12 characterised in that the positioner (19, 119) is disposed in a median position relative to the pair of support rollers (16, 116).

14. A machine for machining cylindrical surfaces of circular cylindrical parts by tangential movement over the cylindrical surface of a workpiece, in at least one machining station, of an abrasive belt which, fed from a pay-out spool, passes over a pressure roller before the abrasive belt is rewound onto a take-up spool, the workpiece being supported by a pair of spaced parallel support rollers, characterised in that said machine further comprises a support assembly (12, 112) on which the support rollers (16, 116) are mounted so that they can rotate about their axis, a machining assembly (5, 105) carrying the machining station or stations (6, 106), one of said assemblies being mobile in translation parallel to the axis of the support rollers relative to the other assembly, means (4, 104) for rotating the rollers about their axis, and means (3, 103) for moving one of said assemblies in translation parallel to the axes of the support rollers relative to the other assembly, wherein the machining assembly (5, 105) is mobile and is moved in translation relative to the stationary support assembly (12, 112), wherein the support assembly (12) includes at least one pair of support rollers (16) mounted on a table (13) moved in translation, characterised in that the mobile assembly (12, 105) is moved in translation by a screw-nut drive system (3, 4, 103).

* * * * *